US005183259A

United States Patent [19]

Lyon

[11] Patent Number: 5,183,259

[45] Date of Patent: Feb. 2, 1993

[54] FLUID RESERVOIR CONTAINING ARROW

[76] Inventor: Robert K. Lyon, 4257 Wedgewood Ct., Indianapolis, Ind. 46254

[21] Appl. No.: 828,039

[22] Filed: Jan. 30, 1992

[51] Int. Cl.[5] ..... F42B 6/04

[52] U.S. Cl. ..... 273/418; 239/37; 239/58

[58] Field of Search ..... 273/418, 416; 239/37–43, 58, 211

[56] References Cited

U.S. PATENT DOCUMENTS

| | | | |
|---|---|---|---|
| 500,734 | 7/1893 | Bennett | 239/38 |
| 859,183 | 7/1907 | Sprague et al. | 239/37 |
| 2,554,012 | 5/1951 | Cohen | 273/418 |
| 4,093,229 | 6/1978 | Kelling | 273/418 |
| 4,277,069 | 7/1981 | Rouse | 273/418 |
| 4,712,737 | 12/1987 | Hecking | 239/58 |
| 4,726,584 | 2/1988 | Bishop | 273/418 |
| 4,772,029 | 9/1988 | Watkins | 273/416 |
| 4,881,743 | 11/1989 | Fiorenzo | 273/418 |
| 4,969,599 | 11/1990 | Campbell | 239/58 X |
| 5,035,435 | 7/1991 | Burgeson et al. | 273/418 |
| 5,123,657 | 6/1992 | Colt et al. | 273/418 |

*Primary Examiner*—Paul E. Shapiro

*Attorney, Agent, or Firm*—Ice Miller Donadio & Ryan

[57] ABSTRACT

An arrow includes a first shaft member, and a second shaft member. The second shaft member has an exterior surface and an interior surface defining a reservoir portion capable of containing a fluid. The arrow also includes a coupling member for coupling together the first and second shaft member. The coupling member includes a first and second cap member. The first cap member has an outer surface attachable to the first shaft member, and a threaded inner surface. The second cap member has an outer surface attachable to the interior surface of a second shaft member, a threaded inner surface, and an aperture in fluid communication with the reservoir portion. A stud member is provided which has a first threaded end portion for threadedly engaging the first cap member, a second threaded end portion for threadedly engaging a second cap member, a middle portion extending between the first and second end portions, a first fluid conduit extending in at least a portion of each of the second portion a middle portion, and sealing means for selectively sealingly engaging the first and second shaft members to controllably regulate the flow of fluid therebetween.

17 Claims, 3 Drawing Sheets 70
68
D
10
200
H
198

FLUID RESERVOIR CONTAINING ARROW

TECHNICAL FIELD OF THE INVENTION

The present invention relates to hunting devices, and more particularly to archery type hunting devices.

BACKGROUND OF THE INVENTION

Since at least the middle ages, man has used archery equipment to hunt game. Archery equipment typically includes a projectile launching instrument such as a bow, a compound bow, or a cross bow, and a projectile such as an arrow, which can be launched by the projectile launching apparatus. Archery equipment also includes accessory items such as gloves for the user, sights for the projectile launching equipment, and quivers for storing arrows.

Those familiar with hunting game will recognize that scent is a factor which must be managed during the tracking and hunting of game. Most game animals, such as deer have a sense of smell which is far more sensitive than that possessed by humans, and can detect scents which cannot be discerned by humans. In order to attract a game animal, the presence or absence of scent must be managed by the hunter.

The hunter can manage scent in two ways. The first way is to avoid producing any scents which will scare off the target animal. Among the scents that the hunter wishes to avoid are those scents which are distinctly human or man-made scents that alert the target animal to the presence of humans. Particularly to be avoided are perfume and soap type scents. For this reason, many hunters will not bathe for several days before going deer hunting, or otherwise will bathe in special perfume-free soaps to ensure that they do not give off any perfume or soap scents which can be detected by the deer.

The second way in which scent can be managed is to produce scents which are designed to attract a game animal.

It has been known for some time that most, if not all animals release certain volatile chemicals which attract other members of their species. Often, the members of the species attracted are those of the opposite gender. These sex attractants are known as pheromones. For example, the pheromone secreted by the queen bee will attract drones from a wide downwind area, to allow the drones to know that the queen is ready to mate. Similarly, mammals also secrete pheromones. Pheromones secreted by a doe will alert bucks in a wide downwind area of the presence of the doe and, under certain circumstances of her willingness to engage in mating behavior.

Scientists have determined which chemicals comprise this pheromone and hunters have learned to take advantage of the attracting power of pheromones. Deer pheromone is now commercially available in liquid form.

The deer pheromone typically is packaged in a bottle which the hunter carries with him into the field. To use the attractant, the hunter opens the bottle and places some of the liquid on the ground or on trees or bushes that are positioned at a point where the hunter would take his shot (the target area). Typically, this target area may be in a clearing in the woods adjacent to the tree in which the hunter has positioned his tree stand.

After sprinkling the liquid attractant onto the ground, the hunter will climb a nearby tree and remain stationary in a tree stand within the tree, and wait for a suitable target animal, such as a buck to appear. When the buck is attracted by the attractant to the clearing, the hunter will launch his arrow at the buck in an attempt to kill the buck.

Several problems exist with this method of using an attractant. One difficulty is that the hunter may leave a sufficient amount of his own scent in the target area to cause the target animal to avoid the target area even with the presence of an attractant.

To overcome this problem, the Applicant has knowledge of the existence of an arrow which contains a spring loaded scent canister. The arrow can be fired by the hunter at the spot to which the hunter desires to attract the target animal. Upon impact with the ground, the canister mechanism releases a spray containing all of the attractant placed in the canister. Although this arrow represents an improvement over the manual placement of scent in a particular area, room for improvement exists.

The primary drawback with the above-mentioned arrow is that it is believed to release all of the attractant it contains at one time. This has the disadvantage of expending all of the attractant immediately. As the attractant is generally of a volatile nature, the attractant soon evaporates leaving little residue to attract any animals who might be downwind of the target area at any substantial time after the attractant has dissipated.

It is therefore one object of the present invention provide an arrow which contains a reservoir for carrying a fluid which overcomes the problems discussed above.

SUMMARY OF THE INVENTION

In accordance with the present invention, an arrow is provided that comprises a shaft portion, a head portion and a tail portion. The head portion is disposed at a first end of the shaft portion, and the tail portion is disposed at a second end of the shaft portion. A reservoir portion is provided for containing a fluid. A first fluid conduit means is provided for conducting fluid from the reservoir.

In a preferred embodiment, the shaft portion includes a first shaft member, a second shaft member and a coupling means for removably coupling the first and second shaft portions. The coupling means includes a stud member which is selectively attachable to each of the first and second shaft portions for attaching the first shaft member to the second shaft member.

Additionally, the arrow preferably includes a sealing means for selectively sealingly engaging the first and second shaft members to prevent the flow fluid therebetween. The sealing means also controllably regulates the flow of fluid out of the fluid conduit and reservoir.

One feature of the present invention is that an arrow is provided having a reservoir which is capable of containing a game attractant fluid, such as a pheromone. This feature has the advantage of enabling the hunter to better place the attractant at a location of his choosing. Additionally, the placement of the attractant in an arrow which can be shot to the desired location helps to provide a better spatial separation between the hunter's scent and the scent given off by the attractant. By increasing the spatial separation between the hunter's scent and the attractant's scent, one reduces the likelihood that the hunter's scent will scare off the target animal.

Another feature of the present invention is that the hollow interior portion of the arrow comprises the reservoir. This feature has the advantage of simplifying the design of the product, and eliminating the need for extra parts. By simplifying the design, reliability is enhanced and the likelihood of breakdown is reduced.

It is also a feature of the present invention that the arrow includes a sealing means for selectively sealing the fluid conduit for controllably regulating flow of the attractant through and out of the fluid conduit through which the fluid flows from the reservoir to the exterior of the arrow. This controlled fluid flow allows the attractant fluid to be emitted from the arrow over a relatively long period of time. This increased duration of the emission of the attractant increases the likelihood that the target animal will be in an area where it can pick up the scent of the attractant, and thus increases the likelihood that a target animal will be attracted by the attractant.

Additional features and advantages of the present invention will become apparent to those skilled in the art upon consideration that the following detailed description of a preferred embodiment exemplifying the best mode of carrying out the invention as perceived presently.

DETAILED DESCRIPTION

Figures 1, 6:
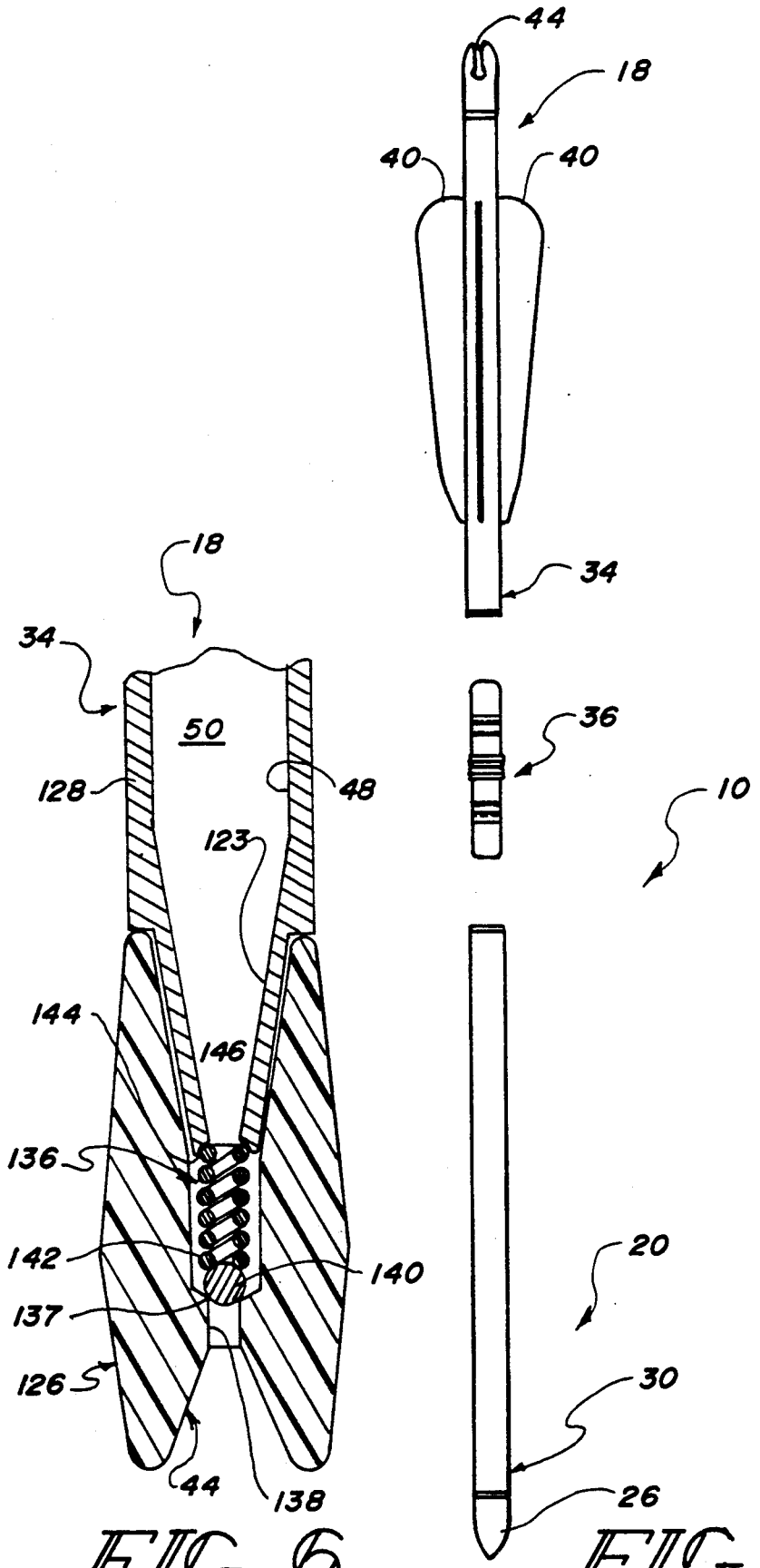
FIG. 1 is an exploded elevational view of the arrow of the present invention.
FIG. 6 is an enlarged sectional view of the tail end portion of the arrow of the present invention.

An arrow 10 is shown in FIG. 1 as including a head portion 14, a tail portion 18 and a shaft portion 20. The shaft portion 20 extends between the head portion 14 and the tail portion 18. The head portion 14 includes a removable head member 26. The removable head member 26 typically includes a threaded male inner portion which can be threadedly engaged with a female threaded socket in the head portion end of the shaft portion 20.

As will be appreciated by those who hunt, a removable head member 26 is a desirable feature for several reasons. First, the head member 26 is the part of the arrow 10 most likely to become worn through use. Thus, the ability to replace the head member 26 can prolong the life of the arrow 10. Additionally, different types of head members 26 are used for different purposes. The head member 26 shown in FIG. 1 is bullet shaped and weighted, and is designed primarily for use when target shooting. When hunting, however, a head member 26 containing four perpendicularly disposed razor blades (not shown) is often preferred as such a head member is better able to penetrate through the flesh of the target animal. Other types of removable head members 26 are well known to those skilled in the art.

The shaft portion 20 includes a first shaft member 30 disposed adjacent to the head portion 14, and a second shaft member 34 disposed adjacent to the tail portion 18. Coupling means 36 are provided for coupling together the first shaft member 30 and the second shaft member 34. The purpose and structure of the coupling means 36 will be discussed in more detail below.

The second shaft member 34 also includes four perpendicularly spaced guidance fins 40 for improving the flight characteristics of the arrow 10. The tail portion 18 includes a slotted end 44 which is sized and positioned to receive the string of the bow (not shown) with which the arrow 10 is used.

Figure 2:
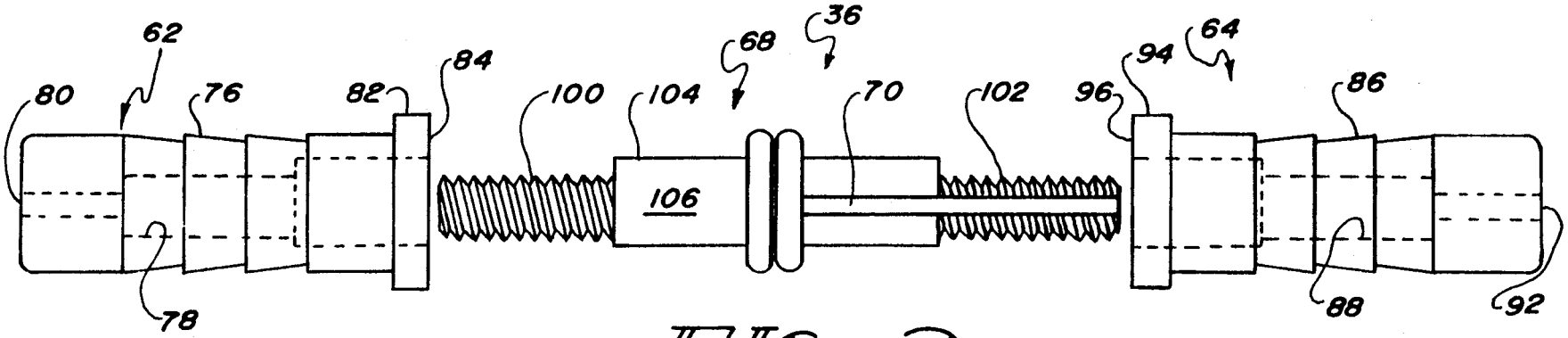
FIG. 2 is an exploded elevational view of the coupling means of the present invention.
Figure 3:
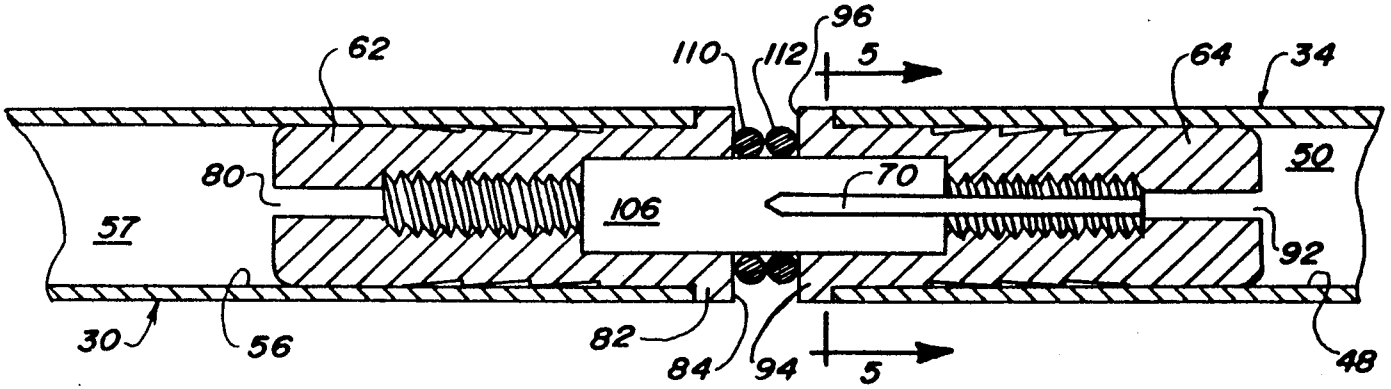
FIG. 3 is a partly sectional view of a portion of the arrow, showing the stud member in elevation.

Referring now to FIGS. 2 and 3, the second shaft member 34 is generally tubular, and includes an interior surface 48 which defines a generally hollow interior 50 of the second shaft member 34. This generally hollow interior 50 comprises a reservoir 50 into which an attractant fluid can be placed. The reservoir 50 extends along almost the entire length of the second shaft member 34, between the second cap member 64 and the tail portion 18. The first shaft member 30 is also generally tubular and includes an interior surface 56 that defines a generally hollow interior 57.

The coupling means 36 is shown in FIGS. 2 and 3 as including a first cap member 62 which is attachable to the interior surface 56 of the first shaft member 30, and a second cap member 64 which is attachable to the interior surface 48 of the second shaft member 34. The coupling means 36 also includes a stud member 68 which includes a first fluid conduit 70 formed thereon.

The first cap member 62 includes a ribbed exterior surface 76 and a threaded interior surface 78 which defines a central passageway which extends axially throughout the length of the first cap member 62. The ribbed exterior surface 76 is sized and configured to enable the first cap member 62 to be press-fit into the interior of the first shaft member 30, so that the ribbed exterior surface 76 snugly and fixedly engages the interior surface 56 of the first shaft member 30. The interiorly disposed end of the first cap member 62 includes an aperture 80. A radially outwardly extending flange portion 82 is disposed at the exteriorly disposed end of the first cap member 62. Flange portion 82 has a diameter greater than the inner diameter of the first shaft member 30, so that the flange portion 82 remains disposed exteriorly of the first shaft member 30 when the first cap member 62 is engaged with the first shaft member 30. The outer surface 84 of the flange portion 82 is disposed in a plane generally perpendicular to the longitudinal axis of the arrow 10.

The second cap member 64 is generally similar or identical to the first cap member 62. Second cap member 64 includes a ribbed exterior surface 86 and a threaded interior surface 88. The ribbed exterior surface 86 is sized and configured to enable the ribbed exterior surface 86 to snugly, fixedly engage the interior surface 48 of the second shaft member 34 when the second cap member 64 is snap-fit into the second shaft member 34. The threaded interior surface 88 of the second cap member 64 defines an axially extending passageway which extends throughout the length of the second cap member 64. At the interior end of second cap member 64, the axially extending passageway terminates in an aperture 92, to place the axially extending passageway in fluid communication with the reservoir 50. The outwardly disposed end of the second cap member 64 includes a radially outwardly extending flange portion 94 having a diameter greater than the interior diameter of the second shaft member 34, so that the flange portion 94 remains disposed exteriorly of the second shaft member 34 when the second cap member 64 is snap-fit into the interior of the second shaft member 34. The flange portion 94 includes a axially facing, radially extending outer surface 96 which is disposed in a plane generally perpendicular to the longitudinal axis of the arrow 10.

The stud 68 includes a threaded first end portion 100, a threaded second end portion 102, and a middle portion 104. Middle portion 104 extends between the threaded first end portion 100 and the threaded second end portion 102. The middle portion 104 includes an exterior surface 106.

The first threaded end portion 100 is sized to be threadedly received by the threaded interior 78 of the first cap member 62. The threaded second end portion 102 is sized to be threadedly received by the threaded interior surface 88 of the second cap member 64.

The first fluid conduit means 70 comprises an axially extending groove which is cut into the exterior surface 106 of the threaded second end portion 102, and a portion of the middle portion 104 of the stud member 68. The groove extends along the middle portion 104 to a point approximately half-way between the first end 100 and second end 102 portions.

The first fluid conduit 70 is generally large enough to convey droplets of fluid, and is in fluid communication with the aperture 92 disposed at the interior end of the second cap member 64. Thus, the first fluid conduit 70 is in fluid communication with the reservoir 50. However, the first fluid conduit 70 is not in fluid communication with the interior 57 of the first shaft member 30 as the threaded engagement between the first threaded end 100 and the threaded interior surface 78 of cap 62 seals the axially extending passageway through the cap member 62 to prevent the flow of fluid there through.

Selectively engagable sealing means are provided on the middle portion 104 of the stud 68 to controllably regulate the flow of fluid in the first conduit 70, and hence controllably regulate the flow of fluid from the reservoir 50 to the exterior of the arrow 10. In the embodiment shown in FIG. 1, the sealing means comprises a pair of torus-shaped O-rings 110, 112. O-rings 110, 112 are preferably composed of an elastomeric material such as rubber or soft plastic.

The threaded engagement between the end portions 100, 102 of the stud 106 and the threaded interior surfaces 78, 88 of the first and second end cap members 62, 64 permits the user to variably position the first and second shaft members 30, 34 by varying the axial distance therebetween. The first and second shaft members 30, 34 are infinitely axially adjustable with respect to each other between a position wherein the first and second shaft members 30, 34 disengage from each other, and a position, such as shown in FIG. 3, wherein the first and second shaft members 30, 34 are sealingly engaged.

When the first and second shaft members 30, 34 are sealingly engaged, the first O-ring 110 is tightly engaged with both the axially outer surface 84 of the flange portion 82 of the first cap member 62, and also the second O-ring member 112. Additionally, when the first and second shaft members 30, 34 are sealingly engaged, the second O-ring member 112 is tightly engaged with both the first O-ring member 110, and the axially outwardly facing surface 96 of the flange portion 94 of the second cap member 64. This tight engagement between the surfaces 84, 96 and O-rings 110, 112 prevents fluid in the fluid conduit 70 from leaking past the sealing means 110, 112 and thereby prevents the fluid from finding its way to the exterior of the arrow 10.

It will be appreciated that the amount of fluid flow past the sealing means 110, 112 will be proportional to the axial separation between the first and second shaft members 30, 34. Thus, the user is able to vary the flow of fluid out of the reservoir 50 by adjusting the axial distance between the first and second shaft members 30, 34. For example, when the reservoir 50 is filled with fluid, and the user wishes to prevent any of the fluid within reservoir 50 from escaping from the arrow 10, (such as when he is transporting the arrow), the user can axially adjust the first and second shaft members 30, 34 close to each other to sealingly engage the O-rings 110, 112 with the outer surfaces 84, 96 of the first and second cap members 62, 64. At such time as the user wishes to allow fluid to flow out of the reservoir 50, through the fluid conduit 70, and to the exterior of the arrow 10, (such as when the user is ready to shoot the arrow 10 to its desired position), the user can increase the axial distance between the first shaft member 30, and the second shaft member 34.

A second fluid conduit is formed into the tail portion 18, through which fluid can be introduced into the reservoir 50. This second fluid conduit includes both a conduit 123 formed in the extreme tail portion of the second shaft member 34 and a conduit and valve arrangement 136 formed in the plastic cap 126. The valve arrangement 136 and second conduit cooperate to vent the reservoir 50 only selectively, so that most of the time, the reservoir 50 is not vented. Preferably, the reservoir 50 is not always vented, so that fluid flowing out of the reservoir 50 and through the first fluid conduit 70, must work against the vacuum forces that tend to keep the fluid within the reservoir 50. The exploitation of this vacuum decreases the rate at which fluid 50 can flow from the reservoir to the exterior of the arrow 10, as compared to if the reservoir 50 were vented full time. This relatively slowed rate is desired, as it allows the fluid 50 to be dispensed from the arrow 10 over a longer period of time, thus increasing the likelihood that a target animal will be positioned to pick up the scent of the fluid dispensed from the reservoir 50.

The tail portion 18 of the arrow of the instant invention is shown in FIG. 6. A plastic cap 126 sealingly engages the exterior surface 128 of the extreme tail end portion of the second shaft member 34. The plastic cap 126 is molded so as to include the formed slot 44 at the extreme tail end of the arrow 10, an aperture 138 extending axially through the plastic end cap 126, and a valve arrangement 136 for selectively sealing the conduit, and for thereby selectively venting the reservoir 50.

The valve arrangement 136 includes an annular, radially inwardly extending seat 137 which defines the central aperture 138. The aperture 138 is designed to be large enough to receive a needle of a syringe containing the attractant fluid to be inserted into the reservoir 50. A closure member, such as a ball 140 engages the seat 137 to close the aperture 138. A spring 142 is provided for normally biasing the ball 140 into engagement with the seat 137, to keep the aperture in a normally closed position. A spring seat 144 is also formed to serve as a seat for spring 142. Spring seat 144 also includes an aperture 146 to provide fluid communication with reservoir 50.

In use, the placement of the needle (not shown) of a syringe in aperture 138, causes closure ball 140 to move away from seat 137. Attractant fluid is then forced pass the ball 140, and through aperture 146 into reservoir 50. The removal of the needle from aperture 138 allows the closure in the ball 140 to re-engage the seat 137. The engagement of ball 140 with seat 137 prevents the escape of fluid through aperture 138, and helps to prevent an air vent from being formed when fluid is being dispensed from the reservoir.

Preferably the ball 140 and aperture 138 form an imperfect seal. Applicant has found that if a perfect seal is formed, the flow of fluid from the reservoir 50 can be completely impeded. The formation of an imperfect seal between the ball 140 and the aperture 138 allows only a small amount of air through the aperture 138. This permits the fluid to flow from the reservoir at a desired slow rate, without encountering the too rapid flow that would exist if aperture 138 were completely open to atmosphere air.

Figures 4, 5:
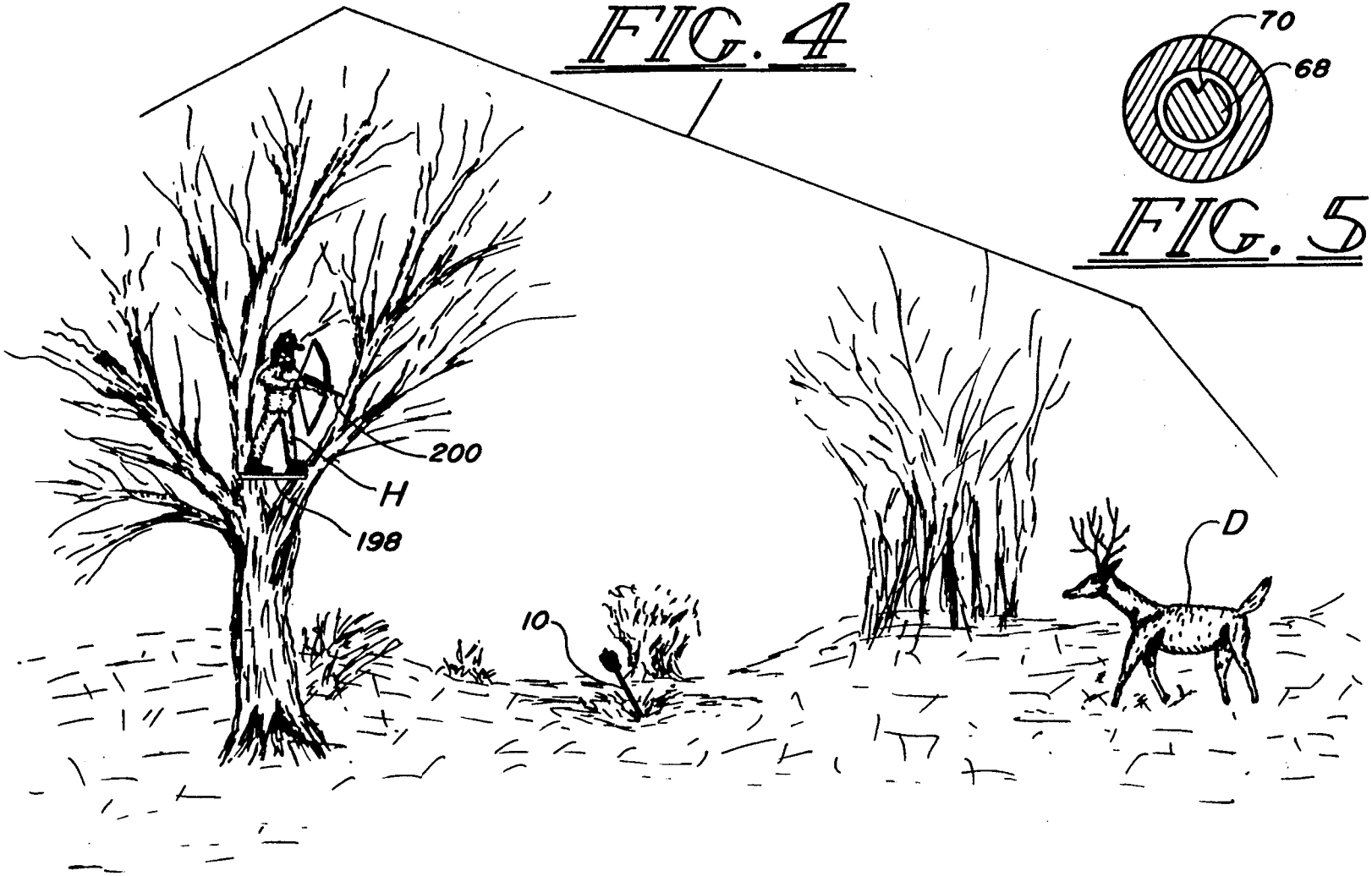
FIG. 4 is a perspective view of the environment in which the arrow of the present invention is used.
FIG. 5 is a sectional view taken along the lines 5—5 of FIG. 3.

The use of the device can best be described with regard to FIG. 4. In FIG. 4, a hunter H is tracking a target animal, such as a deer D. In order to hunt the deer D, the hunter H places a tree stand 198 in a tree, and climbs on the tree stand 198. The hunter takes the arrow 10 of the present invention, and axially adjust the first and second shaft members 30, 34 so that the O-rings 110, 112 sealingly engage the outer surfaces 84, 96 of the first and second cap members 62, 64. This prevents any fluid from flowing out of the arrow 10. The user then inserts the attractant fluid, such as a deer pheromone into the reservoir 50 of the arrow 10, as described above. The hunter H then axially adjusts the first and second shaft members 30, 34 slightly apart to slightly disengage the O-rings 110, 112 from the outer surfaces 84, 96 to permit the attractant fluid to flow from the reservoir 50 through the first fluid conduit 70, and out of between the first and second arrow members 30, 34. The hunter H then uses his bow to shoot the arrow 10 to a desired spot, such as a clearing. The hunter should choose his spot carefully, so that when the target animal, such as deer D is standing adjacent to the arrow 10, the hunter will have a clear shot with his game arrow 200.

When the arrow 10 strikes the ground, the impact from the strike will cause the ball 140 of valve arrangement 136 to become unseated momentarily from the seat 137. This momentary unseating of the ball 140 allows a small slug of air to pass around the ball 140 and to enter the reservoir 50, thus selectively venting the reservoir 50. This selective venting of reservoir 50 helps to promote the start of fluid flow out of the reservoir 50.

The controlled slow release of the pheromone from the arrow 10, under the influence of gravity will cause the attractant to exit from the arrow 10 normally about a foot or two above the ground. The fluid will pass between the outer surfaces 84, 96 of the end caps 62, 64 to the exterior of the arrow 10 where it will encounter atmospheric air. The air will volatilize some of the fluid and carry it downwind, while allowing the remainder of the fluid to drip onto the ground where it can later be volatilized by the ambient air. Ambient air will carry the volatilized fluid downwind wherein the scent given off by the fluid can be by sensed the target deer D. The deer D smelling the pheromone will be attracted to the arrow 10, on the mistaken belief that the pheromone represents another animal, such as a doe. As the target animal approaches the arrow 10 that is stuck into the ground in the clearing, the hunter then can use his game arrow 200 to shoot and kill the target animal D.

Although the invention has been described in detail with reference to the illustrated preferred embodiments, variations and modifications exist within the scope and spirit of the invention as described and as defined in the following claims.

What is claimed is:

1. An arrow comprising:

a shaft portion;

a head portion disposed at a first end of the shaft portion;

a tail portion disposed at a second end of the shaft portion;

a reservoir portion for containing a fluid;

a first fluid conduit means for conducting fluid from the reservoir;

a second fluid conduit through which fluid can be introduced into the reservoir, the second fluid conduit including a valve means for selectively closing and opening the second fluid conduit, the valve means including;

a seat defining an aperture;

a closure member engageable with the seat; and a spring means for biasing the closure member into engagement with the seat.

2. An arrow comprising:

a shaft portion;

a head portion disposed at a first end of the shaft portion;

a tail portion disposed at a second end of the shaft portion;

a reservoir portion for containing a fluid; and a first fluid conduit means for conducting fluid from the reservoir, the shaft portion including:

a first shaft member disposed adjacent the head portion;

a second shaft member disposed adjacent the tail portion; and a coupling means for removably coupling together the first and second shaft members, the coupling means including:

said first fluid conduit;

a first cap member attachable to the first shaft member;

a second cap member attachable to the second shaft member; and a stud member selectively attachable to each of the first and second cap members for attaching the first shaft member to the second shaft member.

3. The invention of claim 2 wherein the stud member includes a sealing means and includes said first conduit means.

4. The invention of claim 3 wherein the sealing means comprises an O-ring, and the first conduit means comprises an axially extending groove formed in the stud member, the O-ring being sized and positioned to sealingly engage the first and second shaft members to controllably regulate the flow of fluid from the first conduit.

5. The invention of claim 3 wherein each of the first and second cap members includes a flange portion disposed in a plane generally perpendicular to an axis of the first and second shaft member; and the sealing means comprises an O-ring sized and positioned to sealingly engage the flange portions to prevent the flow of fluid from the first conduit.

6. The invention of claim 5 wherein said second shaft member has a generally hollow interior defining said reservoir portion, the second cap member includes an aperture in fluid communication with the reservoir portion, and the first fluid conduit of the stud member is in fluid communication with the aperture of the second cap member.

7. The invention of claim 6 wherein the second shaft portion includes an interior surface, the stud member includes a threaded second end portion, and the second cap member includes a ribbed exterior surface for securely gripping the interior surface of the second shaft member, and a threaded interior surface for threadedly receiving the second end portion of the stud member.

8. The invention of claim 7 wherein the stud member includes an exterior surface, a first end portion, a middle portion, the second end portion, and an axially extending groove which extends between the second end portion and the middle portion, the axially extending groove comprising the first fluid conduit means.

9. The invention of claim 8 wherein said O-ring is disposed on the middle portion of the exterior surface of the stud member adjacent an end of the axially extending groove.

10. An arrow comprising:

a shaft portion, the shaft portion including a first shaft member and a second shaft member, the second shaft member having a generally hollow interior that defines a reservoir portion for containing a fluid;

a head portion disposed at a first end of the shaft portion;

a tail portion disposed at a second end of the shaft portion;

a first fluid conduit means for conducting fluid from the reservoir; and a coupling means for coupling together the first and second shaft members, the coupling means including, the first fluid conduit and a cap member attachable to the second shaft member, the cap member including an aperture means for placing the first fluid conduit in fluid communication with the reservoir portion.

11. The invention of claim 10 wherein the coupling means includes a first cap member attachable to the first shaft member, and a stud member, the stud member being selectively attachable to each of the first and second cap members for coupling together the first and second shaft members.

12. The invention of claim 11 wherein the stud member includes an axially extending groove in fluid communication with the second cap member, the groove comprising the first fluid conduit; and a torus shaped sealing means for selectively sealingly engaging the first and second cap members to prevent the flow of fluid from the first fluid conduit.

13. The invention of claim 10 further comprising a selectively engageable sealing means for preventing the flow of fluid from the first fluid conduit.

14. An arrow comprising;

a first shaft member;

a second shaft member having an exterior surface, and an interior surface defining a reservoir portion capable of containing a fluid;

a first cap member having an outer surface attachable to the first shaft member, and a threaded inner surface;

a second cap member having an outer surface attachable to the interior surface of the second shaft member, a threaded inner surface, and an aperture in fluid communication with the reservoir portion; and a stud member having a first threaded end portion for threadedly engaging the first cap member, a second threaded end portion for threadedly engaging the second cap member, a middle portion extending between the first and second end portions, a first fluid conduit extending in at least a portion of each of the second end portion and middle portion, and a sealing means for selectively sealingly engaging the first and second shaft members to controllably regulate the flow of fluid therebetween.

15. The invention of claim 14 wherein the first and second cap members each include a flange portion, the sealing means comprises a torus-shaped sealing means selectively engageable with the flange portions of the first and second cap members for controllably regulating the flow of fluid in and out of the first fluid conduit.

16. The invention of claim 14 wherein the second shaft member includes a second fluid conduit in fluid communication with the reservoir, and a selectively attachable cap member placeable over the second fluid conduit.

17. An arrow comprising:

a shaft portion having an exterior, the shaft portion including a first shaft member and a second shaft member, the second shaft member having a generally hollow interior that defines a reservoir portion for containing a fluid;

a head portion disposed at a first end of the shaft portion;

a tail portion disposed at a second end of the shaft portion; and a coupling means for coupling together the first and second shaft members, the coupling means including a stud member, the stud member being selectively attachable to each of the first and second shaft members for coupling together the first and second shaft members, the stud member including an axially extending, exteriorly disposed groove in fluid communication with the reservoir, and placeable in fluid communication with the exterior of the shaft member, the groove comprising a first fluid conduit means for conducting fluid from the reservoir to the exterior of the arrow.

* * * * *